US012435734B1

(12) United States Patent
Kuo et al.

(10) Patent No.: US 12,435,734 B1
(45) Date of Patent: Oct. 7, 2025

(54) VENTILATION FAN DEVICE

(71) Applicant: DELTA ELECTRONICS, INC., Taoyuan (TW)

(72) Inventors: Chun-Yi Kuo, Taoyuan (TW); Wen-Chih Li, Taoyuan (TW); Chun-Wei Chen, Taoyuan (TW); Yen-Lin Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 19/063,198

(22) Filed: Feb. 25, 2025

(30) Foreign Application Priority Data

Sep. 30, 2024 (CN) ..... 202411378898.6

(51) Int. Cl.
*F04D 29/58* (2006.01)
*F04D 17/16* (2006.01)
*F04D 29/46* (2006.01)

(52) U.S. Cl.
CPC ..... *F04D 29/462* (2013.01); *F04D 17/16* (2013.01); *F04D 29/582* (2013.01)

(58) Field of Classification Search
CPC ..... F04D 29/462; F04D 17/16; F04D 29/582
See application file for complete search history.

(56) References Cited

U.S. PATENT DOCUMENTS 2,649,242 A * 8/1953 Payne ..... F24H 3/065 415/150
2,834,535 A * 5/1958 Autry ..... F04D 29/462 415/148
3,575,387 A * 4/1971 Bradley, Jr. ..... F04D 29/462 261/111
5,738,492 A * 4/1998 Stanko ..... F24F 13/06 415/212.1
6,817,832 B2 * 11/2004 Kim ..... F04D 29/441 415/206
2006/0081367 A1 * 4/2006 Chiu ..... F04D 29/161 165/296
2009/0274551 A1 * 11/2009 Messmer ..... F04D 29/4226 415/206
2011/0250048 A1 * 10/2011 June ..... F04D 29/4226 702/45
2017/0023024 A1 * 1/2017 Hsin ..... F04D 25/0613
2018/0231022 A1 * 8/2018 Park ..... F04D 29/282
2021/0062825 A1 * 3/2021 Zhong ..... F24F 13/1426

* cited by examiner

*Primary Examiner* — Nathaniel E Wiehe
*Assistant Examiner* — Theodore C Ribadeneyra
(74) *Attorney, Agent, or Firm* — HDLS IPR SERVICES; Chun-Ming Shih

(57) ABSTRACT

A ventilation fan device includes a base, a fan module, and an air guide assembly. The base includes a cover and a shell. The cover includes a first inlet and a first outlet. The shell includes a second outlet. The cover is combined with the shell. The fan module is installed on the shell and includes a housing and a centrifugal fan. The housing includes a second inlet and an air duct communicating with the second inlet. The housing includes a wing-shaped part located in the air duct. The centrifugal fan is disposed in the housing. The air guide assembly includes a stepper motor and an air guide plate. The stepper motor is installed in the wing-shaped part. The air guide plate is disposed in the housing and is driven by the motor.

10 Claims, 8 Drawing Sheets

VENTILATION FAN DEVICE

BACKGROUND OF THE DISCLOSURE

Technical Field

The technical field relates to an air conditioning device, and particularly to a slim ventilation fan device.

Description of Related Art

In existing fan device designs, in order to achieve precise control over the airflow, a stepper motor and an air guide plate are typically placed outside the air duct. This arrangement helps to avoid interference with the airflow caused by the stepper motor, and which makes the maintenance and operation of the guide vane more convenient.

Specifically, the stepper motor and the air guide plate are arranged outside the air duct, and a certain space needs to be reserved around the air duct to accommodate control components and transmission mechanisms. When the size of the fan device is reduced, the internal space of the air duct, especially near the stepper motor and the guide vanes, is restricted. A necking phenomenon of the air duct occurs due to limited space. Moreover, the necking phenomenon not only restricts the free flow of air but also increases airflow resistance within the air duct, which leads to uneven airflow distribution and further affects the performance of the fan.

In view of the above drawbacks, the inventor proposes this disclosure based on his expert knowledge and elaborate researches in order to solve the problems of related art

SUMMARY OF THE DISCLOSURE

This disclosure provides a slim type of ventilation fan device to avoid increasing airflow resistance within the air duct and to maintain the performance of the fan module.

A ventilation fan device includes a base, a fan module, and an air guide assembly. The base includes a cover and a shell. The cover includes a first inlet and a first outlet. The shell includes a second outlet. The cover is combined with the shell. The fan module is installed on the shell and includes a housing and a centrifugal fan. The housing includes a second inlet and an air duct communicating with the second inlet. The housing includes a wing-shaped part located in the air duct. The centrifugal fan is disposed in the housing. The air guide assembly includes a stepper motor and an air guide plate. The stepper motor is installed in the wing-shaped part. The air guide plate is disposed in the housing and is driven by the motor.

In one embodiment of this disclosure, a circulation opening communicating with the air duct and an exhaust opening communicating with the second outlet are defined on the housing; the housing comprises a blocking rib located between the circulation opening and the exhaust opening, and the air guide plate is rotatably disposed on one side of the centrifugal fan to shield the exhaust opening or the circulation opening.

In one embodiment of this disclosure, the housing comprises a base and a lid combined with each other; the centrifugal fan is disposed in the base, and the wing-shaped part is located in the base and protrudes toward the air duct.

In one embodiment of this disclosure, a recess portion is concavely disposed on another side of the wing-shaped part and located on an outer surface of the base, and the stepper motor is installed in the recess portion.

In one embodiment of this disclosure, the wing-shaped part comprises a head section and a tail section extending from the head section; the head section is located adjacent to an outer periphery of the centrifugal fan, and the tail section extends to the air duct and is directed toward the exhaust opening; and an outer end edge of the head section is free from extending beyond a tangent line of the centrifugal fan.

In one embodiment of this disclosure, the height of the wing-shaped part gradually decreases from the head section toward the tail section, and the width of the wing-shaped part gradually decreases from the head section toward the tail section.

In one embodiment of this disclosure, the air guide plate comprises a baffle, a first partition, a second partition, and a third partition all connected to the baffle; the first partition, the second partition, and the third partition are arranged on one side of the baffle to define a first air channel, a second air channel, and a third air channel spacedly; a pivot is disposed on an end of the first partition; a supporting shaft is disposed on ends of the second partition and the third partition; the air guide plate is pivotally combined on the wing-shaped part of the base through the pivot and is pivotally combined on the cover through the supporting shaft to be combined on the air duct of the housing.

In one embodiment of this disclosure, the stepper motor comprises a rotating shaft; an axle hole for inserting the rotating shaft of the stepper motor is defined on the wing-shaped part, and the pivot located at an end of the air guide plate is inserted in the axle hole.

In one embodiment of this disclosure, the air guide plate is driven by the stepper motor to rotate to the circulation opening to let the baffle shield the circulation opening, and the blocking rib covers the third air channel; an airflow generated by the centrifugal fan is rectified through the wing-shaped part and is guided by the air guide plate to flow to the exhaust opening through the first air channel and the second air channel, flow through a heater to be heated, and flow out to external through the second outlet.

In one embodiment of this disclosure, the air guide plate is driven by the stepper motor to rotate to the circulation opening to let the baffle shield the circulation opening, and the blocking rib covers the third air channel; an airflow generated by the centrifugal fan is rectified through the wing-shaped part and is guided by the air guide plate to flow through the first air channel and the second air channel, flowing to the exhaust opening and out to an indoor area from the second outlet.

In comparison with the related art, the ventilation fan device in this disclosure combines the air guide plate on the air duct of the housing, and the wing-shaped part is disposed on the air duct of the housing. Moreover, when the ventilation fan device is in operation, the air guide plate is driven by a stepper motor to rotate and shield the circulation opening or exhaust opening of the housing. As a result, the airflow is guided by the rectification of the wing-shaped part and the air guide plate and flows out to outdoors or indoors, thereby completing ventilation exhaustion or circulation intake. Therefore, the ventilation fan device of this disclosure has a sufficient cross-sectional area of the air duct, and the characteristic of air volume and pressure is maintained. Therefore, when the overall height of the ventilation fan device is reduced, the effect of reducing airflow resistance within the air duct is achieved to avoid uneven airflow distribution. The performance of the ventilation fan device may be maintained without increasing the size of the exhaust pipe, which enhances the practicality of this disclosure.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
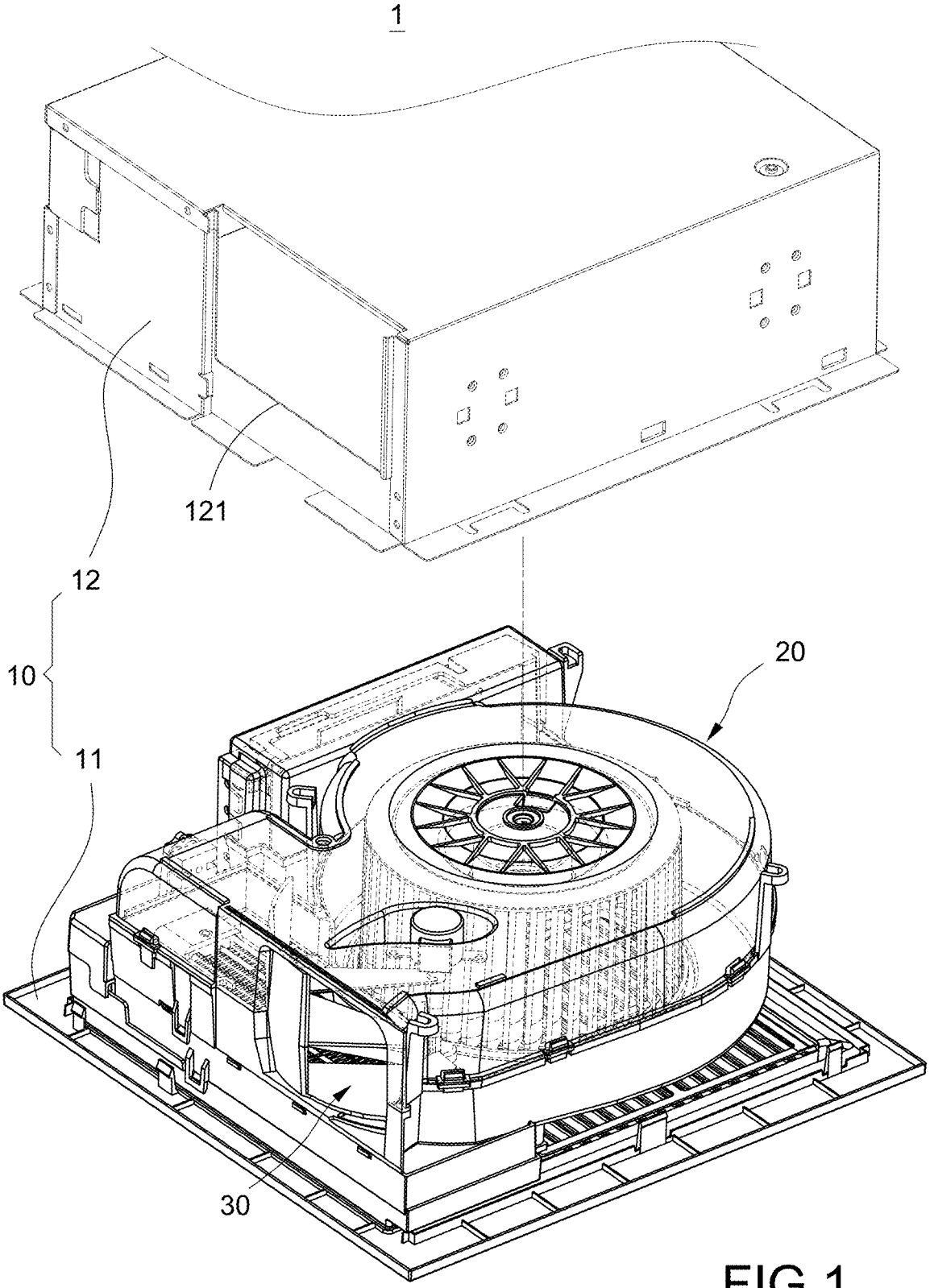
FIG. 1 depicts a perspective schematic view of the ventilation fan device according to this disclosure.
Figure 2:
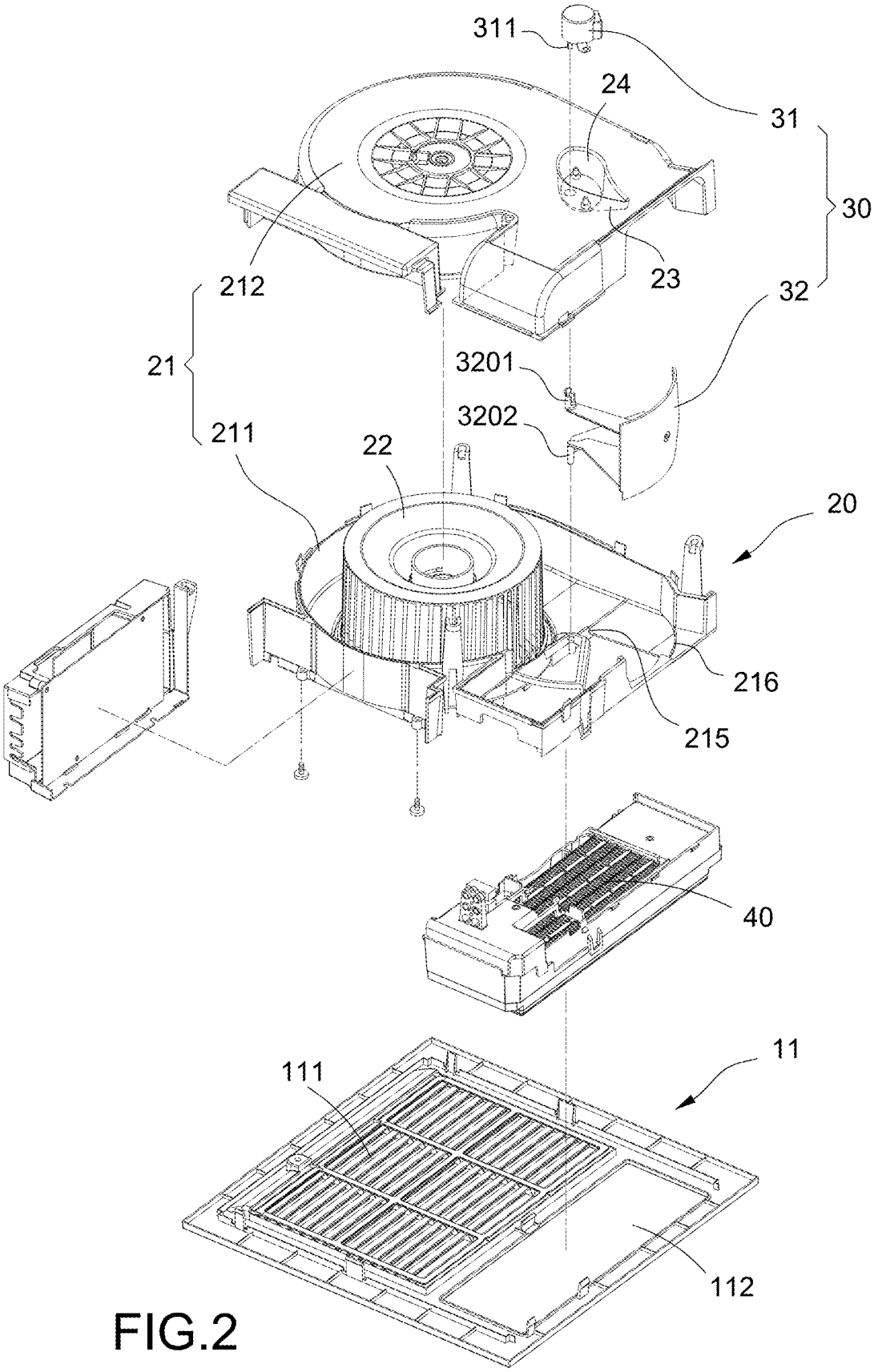
FIG. 2 depicts a perspective exploded schematic view of the ventilation fan device according to this disclosure.

Please refer to FIG. 1 and FIG. 2, which depict a perspective schematic view and a perspective exploded schematic view of the ventilation fan device according to this disclosure. The ventilation fan device 1 includes a casing 10, a fan module 20, and an air guide assembly 30. The fan module 20 is installed in the casing 10. The air guide assembly 30 is combined on the fan module 20 for guiding the airflow inside the fan module 20. More detailed descriptions of the ventilation fan device 1 are as follows.

The casing 10 includes a cover 11 and a shell 12. A first inlet 111 and a first outlet 112 are defined on the cover 11, and the first air inlet 111 is formed by multiple grilles. A second outlet 121 is defined on the shell 12. The fan module 20 is installed in the shell 12. The cover 11 is combined with the shell 12 to enclose the fan module 20. Additionally, the fan module 20 includes a housing 21 and a centrifugal fan 22.

Specifically, the housing 21 includes a base 212 and a lid 211 combined with each other. The centrifugal fan 22 is disposed in the base 212. A protruding wing-shaped part 23 is located inside the base 212, and a recess portion 24 is concavely disposed on the other side of the wing-shaped part 23 and is located on the outer surface of the base 212.

Moreover, the air guide assembly 30 includes a stepper motor 31 and an air guide plate 32. The stepper motor 31 includes a rotating shaft 311. The air guide plate 32 includes a pivot 3201 and a supporting shaft 3202 disposed on two ends thereof. The air guide plate 32 is positioned on the shell 21 through the pivot 3201 and the supporting shaft 3202. The stepper motor 31 is disposed in the recess portion 24 located on the outer surface of the base 212. The rotating shaft 311 of the stepper motor 31 is inserted in the housing 21 through the axle hole 230 located on the recess portion 24 and is combined with the pivot 3201 located at one end of the air guide plate 32. Thus, the air guide plate 32 is positioned on the wing-shaped part 23 and is rotated by the driving of the stepper motor 31. As a result, the air guide plate 32 is rotatably disposed on one side of the centrifugal fan 22 and moves to shield the exhaust opening 216 or away from the exhaust opening 216.

In this embodiment, the ventilation fan device 1 further includes a heater 40. The heater 40 is disposed in the casing 10 and located corresponding to the first outlet 112.

Figure 3:
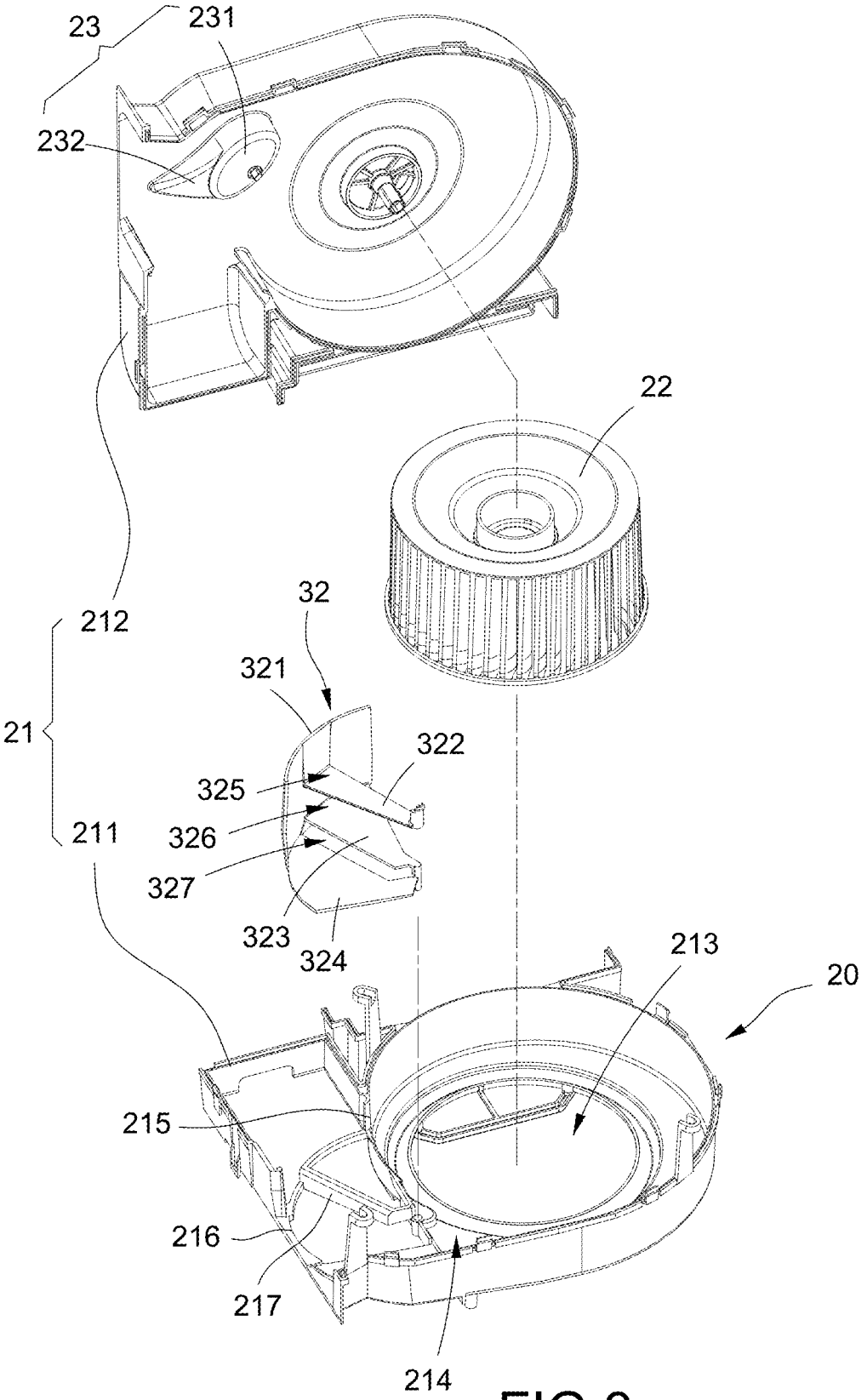
FIG. 3 depicts a partial perspective exploded schematic view of the ventilation fan device according to this disclosure.
Figure 4:
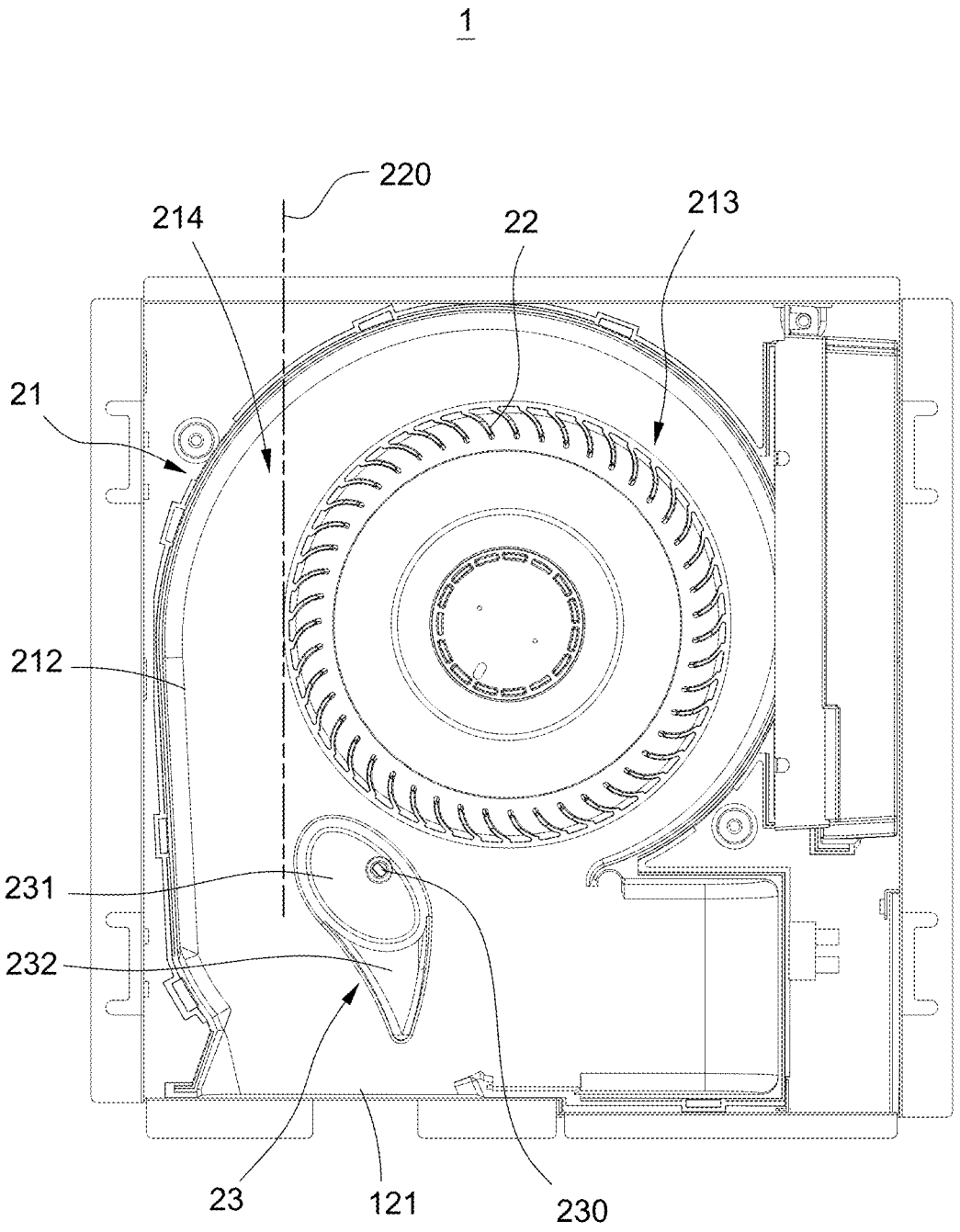
FIG. 4 depicts a plan schematic view of the ventilation fan device according to this disclosure.

Please refer to FIG. 3 and FIG. 4, which depict a partial perspective exploded schematic view of the ventilation fan device according to this disclosure and a plan schematic view of the ventilation fan device according to this disclosure. In this embodiment, the housing 21 includes a second inlet 213, an air duct 214 communicating with the second inlet 213, a circulation opening 215 communicating with the air duct 214, an exhaust opening 216 communicating with the second outlet 121, and a blocking rib 217 located between the circulation opening 215 and the exhaust opening 216. Additionally, the base 212 of the housing 21 includes a wing-shaped part 23 located in the air duct 214. The centrifugal fan 22 is disposed in the housing 21.

Specifically, the air guide plate 32 includes a baffle 321, a first partition 322, a second partition 323, and a third partition 324 all connected to the baffle 321. The first partition 322, the second partition 323, and the third partition 324 are arranged on one side of the baffle 321 to define a first air channel 325, a second air channel 326, and a third air channel 327 spacedly. Moreover, the pivot 3201 is disposed on the end of the first partition 322. The supporting shaft 3202 is disposed on the ends of the second partition 323 and the third partition 324. Thus, the air guide plate 32 is pivotally positioned on the wing-shaped part 23 of the base 212 through the pivot 3201 and is pivotally positioned on the cover 211 through the supporting shaft 3202. As a result, the air guide plate 32 is combined in the air duct 214 of the housing 21.

It should be noted that when the air guide plate 32 rotates to the circulation opening 215, the baffle 321 shields the circulation opening 215, and the blocking rib 217 covers the third air channel 327. Thus, the airflow inside the housing 21 flows to the exhaust opening 216 under the guidance of the air guide plate 32 to achieve the effect of ventilation.

In this embodiment, the wing-shaped part 23 protrudes from the base 212. The wing-shaped part 23 includes a head section 231 and a tail section 232 extending from the head section 231. The height of the wing-shaped part 23 gradually decreases from the head section 231 toward the tail section 232, and the width of the wing-shaped part 23 gradually decreases from the head section 231 toward the tail section 232. Additionally, the head section 231 is located adjacent to the outer periphery of the centrifugal fan 22. The tail section 232 extends to the air duct 214 and toward the exhaust opening 216.

It is worth noticing that the recess portion 24 is concavely disposed on the other side of the wing-shaped part 23 to accommodate the stepper motor 31. Thus, an axle hole 230 is defined on the head section 231 of the wing-shaped part 23 for inserting the rotating shaft 311 of the stepper motor 31 into the housing 21 and to combine with the pivot 3201 located on one end of the air guide plate 32. Thus, the stepper motor 31 may drive the air guide plate 32 to rotate. Furthermore, to ensure that the air guide plate 32 provides a larger area of exhaustion, the position of the rotating shaft 311 of the stepper motor 31 may be as close as possible to the center of the centrifugal fan 22. On the other hand, the outer periphery of the wing-shaped part 23 is free from extending beyond the tangent line 220 of the centrifugal fan 22 (as shown in FIG. 4) to avoid affecting the airflow.

Figure 5:
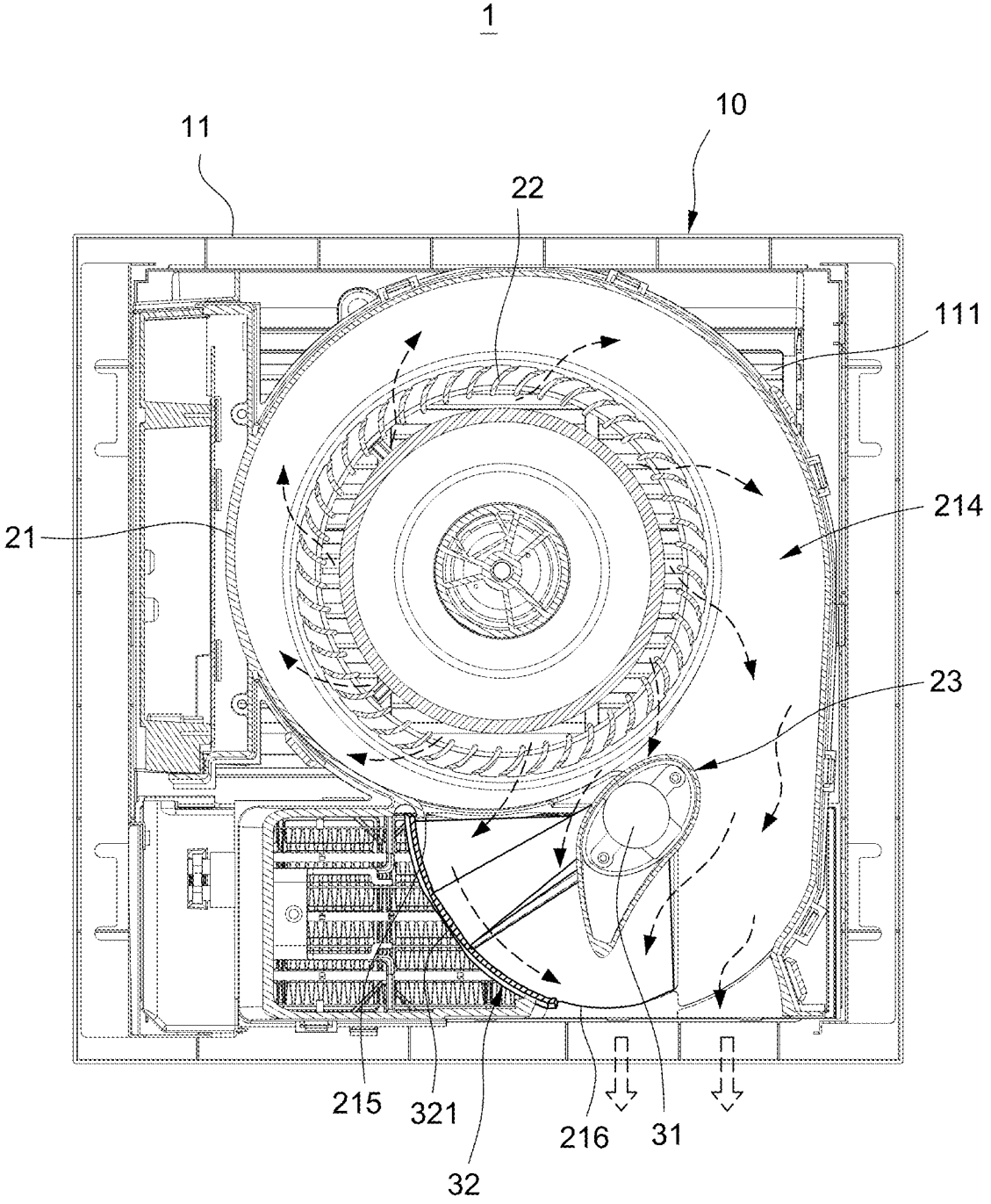
FIG. 5 and FIG. 6 depict airflow schematic views when the ventilation fan device performs the exhaust ventilation according to this disclosure.
Figure 6:
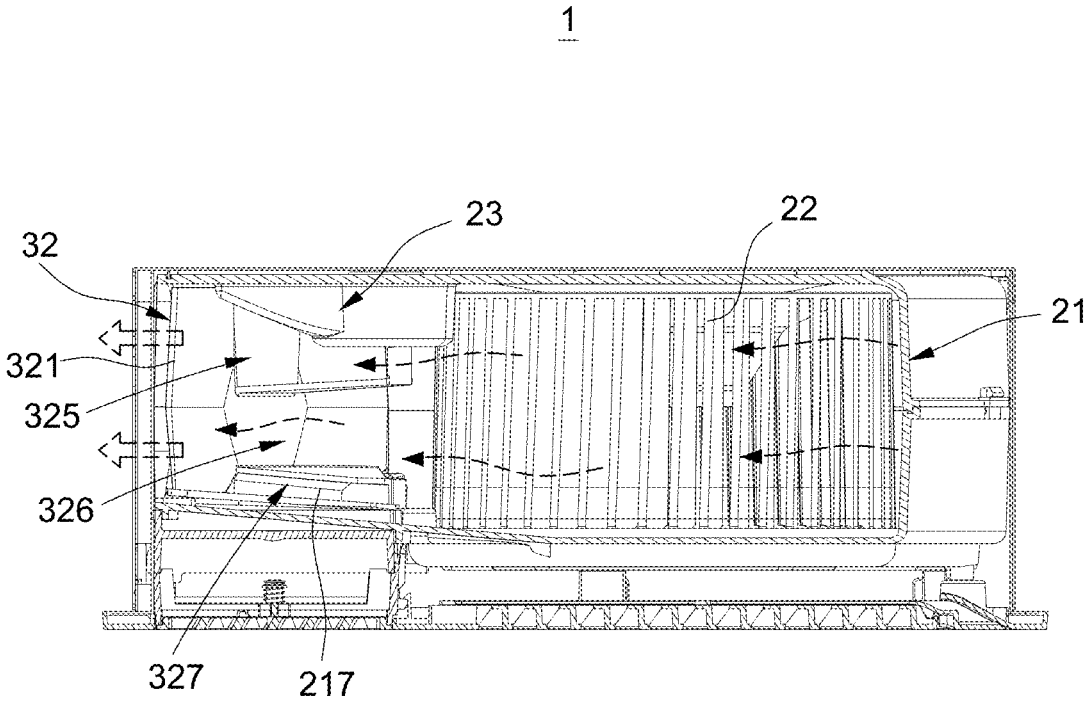

Please refer to FIG. 5 and FIG. 6, which depict airflow schematic views when the ventilation fan device performs exhaust ventilation according to this disclosure. The ventilation fan device 1 includes exhaust ventilation and hot air circulation. When the ventilation fan device 1 performs exhaust ventilation, indoor air flows into the centrifugal fan 22 from the first inlet 111 of the cover 11. The air guide plate 32 is driven by the stepper motor 31 to rotate to the circulation opening 215. Then, the baffle 321 shields the circulation opening 215, and the blocking rib 217 covers the third air channel 327. Moreover, the airflow generated by the centrifugal fan 22 flows into the air duct 214, is rectified through the wing-shaped part 23, and is guided by the air guide plate 32. Thus, the airflow flows to the exhaust opening 216 through the first air channel 325 and the second air channel 326 and flows out through the second outlet 121 to achieve the exhaust ventilation.

Figure 7:
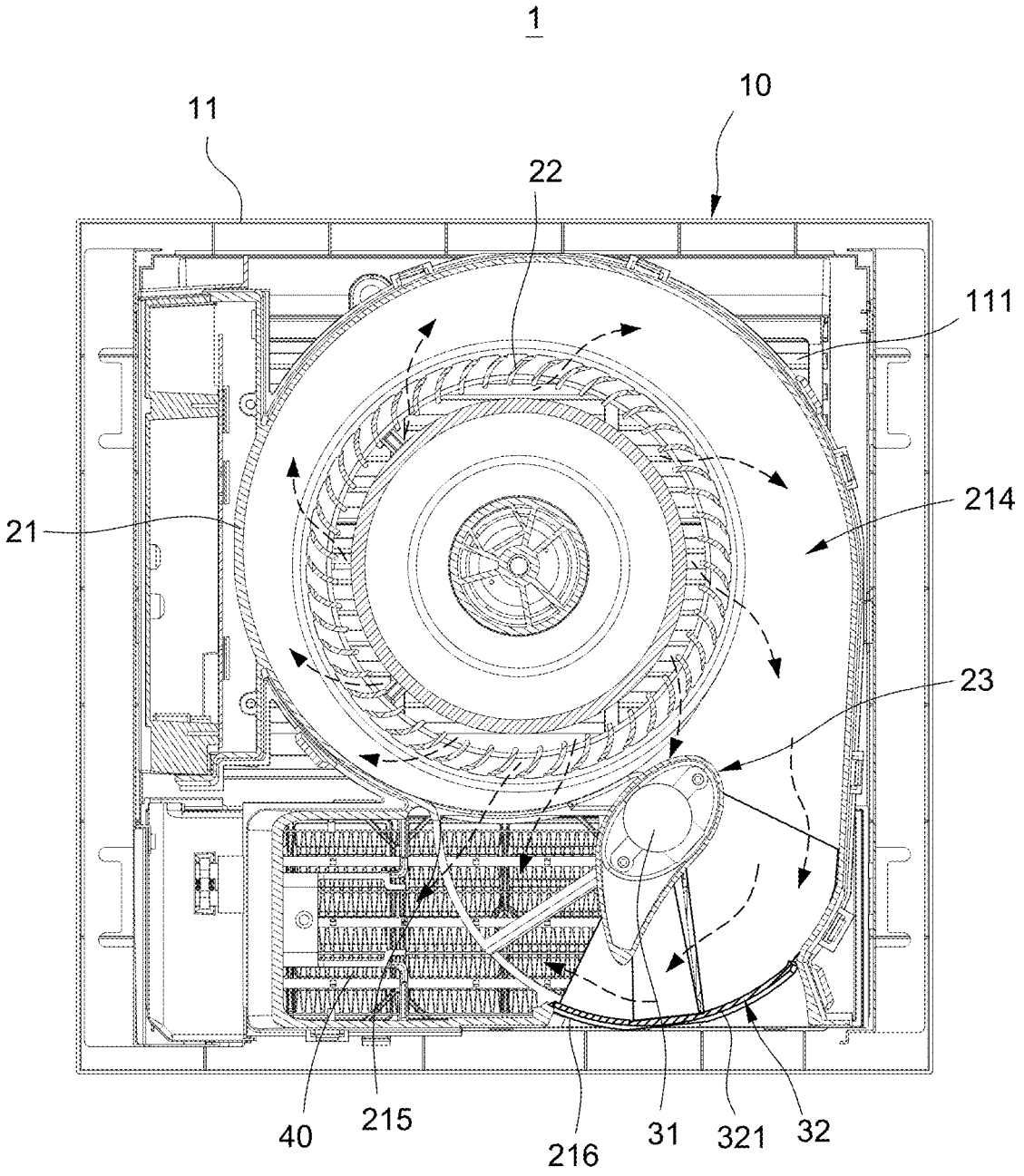
FIG. 7 to FIG. 9 depict airflow schematic views when the ventilation fan device performs the hot air circulation according to this disclosure.
Figure 8:
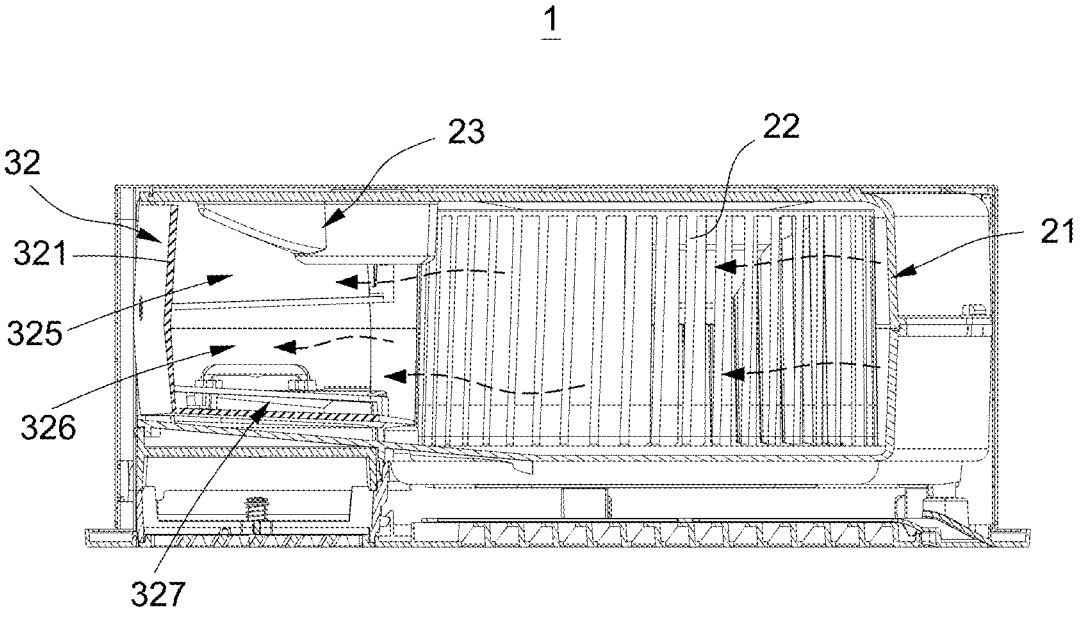
Figure 9:
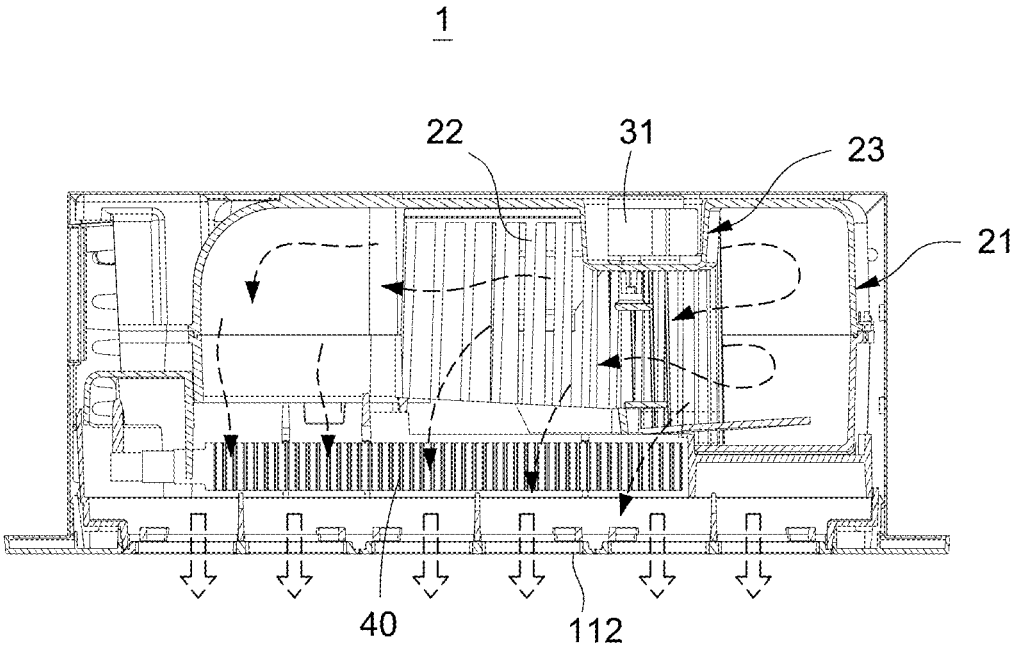

Please further refer to FIG. 7 to FIG. 9, which depict airflow schematic views when the ventilation fan device performs hot air circulation according to this disclosure. When the ventilation fan device 1 performs hot air circulation, indoor air flows into the centrifugal fan 22 from the first inlet 111 of the cover 11. The air guide plate 32 is driven by the stepper motor 31 to rotate to the exhaust opening 216. Then, the baffle 321 shields the exhaust opening 216. Moreover, the airflow generated by the centrifugal fan 22 is rectified through the wing-shaped part 23 and is guided by the air guide plate 32 to flow to the circulation opening 215 through the first air channel 325, the second air channel 326, and the third channel 327, and turning to the heater 40 to become hot air. At the end, the hot air flows out from the first outlet 112 into the room to achieve hot air circulation.

It is worth noticing that when the ventilation fan device 1 performs hot air circulation, the airflow in the housing 21 is rectified as it flows through the air guide plate 32 and the wing-shaped part 23, and the airflow is more evenly distributed after passing through the heater 40.

While this disclosure has been described by means of specific embodiments, numerous modifications and variations may be made thereto by those skilled in the art without departing from the scope and spirit of this disclosure set forth in the claims.

What is claimed is:

1. A ventilation fan device, comprising:

a casing, comprising a cover and a shell, wherein a first inlet and a first outlet are defined on the cover, a second outlet is defined on the shell, and the cover is combined with the shell;

a fan module, installed in the shell, comprising a housing and a centrifugal fan, wherein a second inlet and an air duct communicating with the second inlet are defined on the housing, the housing comprises a wing-shaped part located in the air duct, and the centrifugal fan is disposed in the housing; and an air guide assembly, comprising a stepper motor and an air guide plate, wherein the stepper motor is disposed in the wing-shaped part, and the air guide plate is disposed in the housing and is driven by the stepper motor.

2. The ventilation fan device according to claim 1, wherein a circulation opening communicating with the air duct and an exhaust opening communicating with the second outlet are defined on the housing; the housing comprises a blocking rib located between the circulation opening and the exhaust opening, and the air guide plate is rotatably disposed on one side of the centrifugal fan to shield the exhaust opening or the circulation opening.

3. The ventilation fan device according to claim 2, wherein the housing comprises a base and a lid combined with each other; the centrifugal fan is disposed in the base, and the wing-shaped part is located in the base and protrudes toward the air duct.

4. The ventilation fan device according to claim 3, wherein a recess portion is concavely disposed on another side of the wing-shaped part and located on an outer surface of the base, and the stepper motor is installed in the recess portion.

5. The ventilation fan device according to claim 2, wherein the wing-shaped part comprises a head section and a tail section extending from the head section; the head section is located adjacent to an outer periphery of the centrifugal fan, and the tail section extends to the air duct and is directed toward the exhaust opening; and an outer end edge of the head section is free from extending beyond a tangent line of the centrifugal fan.

6. The ventilation fan device according to claim 5, wherein a height of the wing-shaped part gradually decreases from the head section toward the tail section, and a width of the wing-shaped part gradually decreases from the head section toward the tail section.

7. The ventilation fan device according to claim 2, wherein the air guide plate comprises a baffle, a first partition, a second partition, and a third partition all connected to the baffle; the first partition, the second partition, and the third partition are arranged on one side of the baffle to define a first air channel, a second air channel, and a third air channel spacedly; a pivot is disposed on an end of the first partition; a supporting shaft is disposed on ends of the second partition and the third partition; the air guide plate is pivotally combined on the wing-shaped part of the base through the pivot and is pivotally combined on the cover through the supporting shaft to be combined on the air duct of the housing.

8. The ventilation fan device according to claim 7, wherein the stepper motor comprises a rotating shaft; an axle hole for inserting the rotating shaft of the stepper motor is defined on the wing-shaped part, and the pivot located at an end of the air guide plate is inserted in the axle hole.

9. The ventilation fan device according to claim 7, wherein the air guide plate is driven by the stepper motor to rotate to the circulation opening to let the baffle shield the circulation opening, and the blocking rib covers the third air channel; an airflow generated by the centrifugal fan is rectified through the wing-shaped part and is guided by the air guide plate to flow to the exhaust opening through the first air channel and the second air channel, and flow out to external through the second outlet.

10. The ventilation fan device according to claim 7, wherein the air guide plate is driven by the stepper motor to rotate to the exhaust opening to let the baffle shield the exhaust opening; an airflow generated by the centrifugal fan is rectified through the wing-shaped part and is guided by the air guide plate to flow to the circulation opening through the first air channel, the second air channel and the third air channel, flow through a heater to be heated, and flow out to external through the first outlet.

* * * * *